US009033556B2

(12) United States Patent
Lee

(10) Patent No.: US 9,033,556 B2
(45) Date of Patent: May 19, 2015

(54) ELECTRONIC STICK ASSEMBLY

(71) Applicant: HON HAI PRECISION INDUSTRY CO., LTD., New Taipei (TW)

(72) Inventor: Bing-Heng Lee, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 30 days.

(21) Appl. No.: 13/864,255

(22) Filed: Apr. 17, 2013

(65) Prior Publication Data

US 2014/0119012 A1 May 1, 2014

(30) Foreign Application Priority Data

Oct. 30, 2012 (TW) ..... 101140211 A

(51) Int. Cl.
*F21V 17/02* (2006.01)
*F21S 10/00* (2006.01)

(52) U.S. Cl.
CPC ..... *F21S 10/005* (2013.01)

(58) Field of Classification Search
CPC ..... G02B 6/001; H04M 2250/12; F21W 2121/00; F21S 10/005; F21S 10/04
USPC ..... 362/133, 234, 235, 237, 253, 279, 319, 362/551, 552, 565
See application file for complete search history.

*Primary Examiner* — Meghan Dunwiddie
(74) *Attorney, Agent, or Firm* — Novak Druce Connolly Bove + Quigg LLP

(57) ABSTRACT

An electronic incense-stick assembly includes a burning chamber, a number of electronic sticks simulating burning sticks, a wind speed sensor and a controller. The electronic sticks are arranged in the burning chamber. Each of the electronic sticks includes a light guide bar, a glowing end, and a light source. The light guide bar includes a first end and a second end away from the first end. The light source is positioned at the first end. The glowing head is positioned at the second end and simulates the glowing tip of an incense stick. The wind speed sensor is located on the exterior of the burning chamber, and senses changes in the wind speed outside the burning chamber. The controller adjusts the brightness of the light source according to the wind speed sensed by the wind speed sensor.

10 Claims, 2 Drawing Sheets

ELECTRONIC STICK ASSEMBLY

BACKGROUND

1. Technical Field

The present disclosure relates to an electronic stick assembly.

2. Description of Related Art

Electronic devices which simulate the burning of sticks of incense for example, or sticks of other substances, over a period of time typically include a transparent tube having an opened end and a bulb portion at an opposite end of the tube, non-transparent coatings on an outer surface of the tube to simulate an odorous coating, and a light emitting diode (LED) positioned at the opened end. The LED emits light, which is directed to the bulb portion via multiple internal reflections on an inner surface of the tube. Thus, the electronic stick appears to be glowing and burning. However, the behavior of such electronic sticks is not sufficiently life-like, in particular the glowing tips do not become brighter and more vivid when they are fanned by a breeze, in comparison to the actual and traditional sticks.

Therefore, it is desirable to provide an electronic stick assembly which can overcome the above-mentioned limitations.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure.

DETAILED DESCRIPTION

Figure 1:
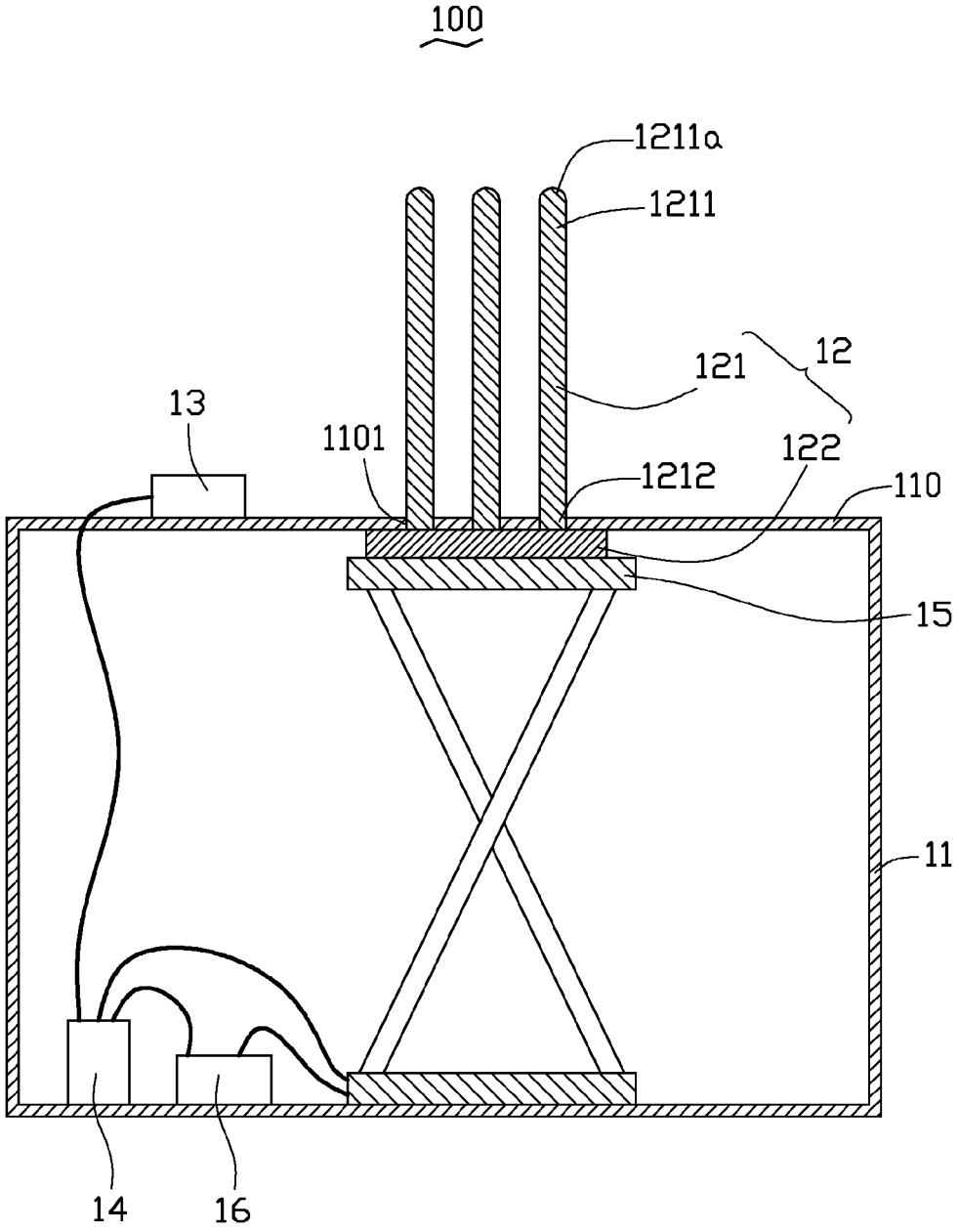
FIG. 1 is a cross-sectional schematic view of electronic stick assembly which includes a burning chamber supporting a number of electronic sticks, according to an embodiment.

FIG. 1 shows an electronic stick assembly 100, according to an embodiment. The electronic stick assembly 100 includes a burning chamber 11, a number of electronic sticks 12 movably received in the burning chamber 11, a wind speed sensor 13, a controller 14, a lifting device 15 and a timing device 16.

The burning chamber 11 is a hollow chamber for receiving the electronic sticks 12, the controller 14, the lifting device 15 and the timing device 16. In the embodiment, the electronic stick assembly 100 also includes a cover 110 for the burning chamber 11. The cover 110 defines a number of through holes 1101.

Each of the electronic sticks 12 includes a light guide bar 121 and a light source 122. The light guide bar 121 includes a first end 1211 and a second end 1212 away from the first end 1211. A glowing head 1211*a* is positioned at the first end 1211. The glowing head 1211*a* is capable of simulating the incandescent glowing tip of traditional incense sticks, when the electronic stick assembly 100 is used. In particular, the glowing head 1211*a* is a bullet shape created by a grinding method.

The light source 122 is positioned on the second end 1212 of the light guide bar 121. The light source 122 can be a lamp or a light emitting diode and configured for emitting light.

The electronic sticks 12 are positioned on the lifting device 15 with each of the light guide bars 121 running through a through hole 1101.

The wind speed sensor 13 is located on the exterior of the burning chamber 11. In the embodiment, the wind speed sensor 13 is positioned on the cover 110, and configured to sense changes in the wind speed outside the burning chamber 11.

The controller 14 is electrically connected to the wind speed sensor 13 and the light source 122. The controller 14 adjusts the brightness of the light source 122 according to the wind speed sensed by the speed sensor 13. In particular, when a wind speed sensed by the speed sensor 13 increases, the controller 14 increases the brightness of the light source 122, and decreases the brightness when the sensed wind speed slows, otherwise the controller 14 maintains the brightness of the light source 122 at a certain stable level. Therefore, the glowing head 1211*a* is capable of simulating traditional incense sticks.

Figure 2:
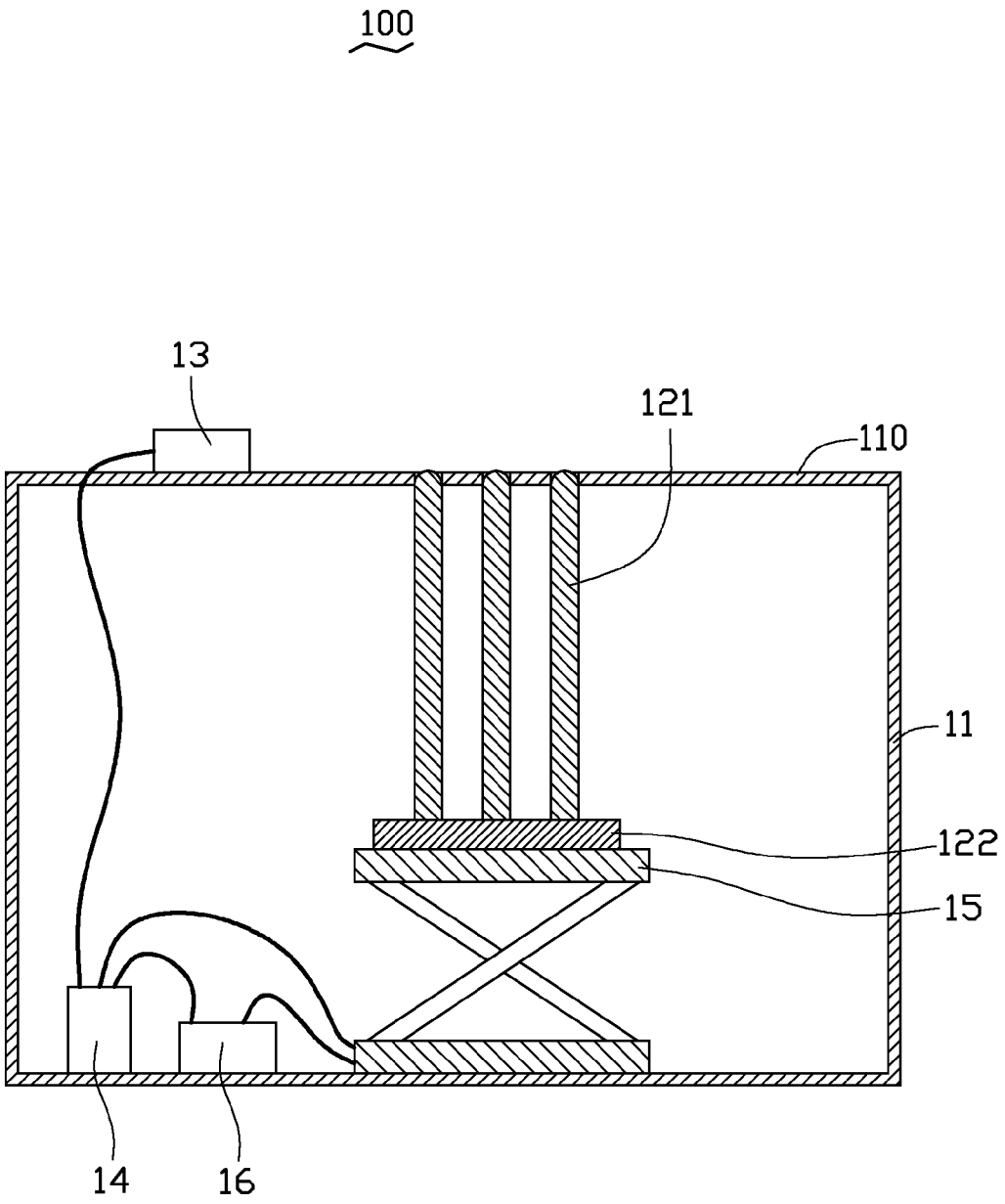
FIG. 2 is similar to FIG. 1, but the electronic sticks are in a retracted state.

The lifting device 15 is electrically connected to the controller 14. The controller 14 controls the lifting device 15 to move the electronic sticks 12 from a first position to a second position along a length direction of the electronic sticks 12, at a uniform speed. In particular, when the electronic sticks 12 are located at the first position, the electronic sticks 12 are totally exposed outside the burning chamber 11, as shown in FIG. 1; when the electronic sticks 12 are located at the second position, the electronic sticks 12 are totally retracted in the burning chamber 11, as shown in FIG. 2, this simulates the lengthwise consumption by burning of traditional incense sticks. After the electronic sticks 12 are located at the second position, the controller 14 controls the lifting device 15 to move the electronic sticks 12 back to the first position.

The timing device 16 is electrically connected to the lifting device 15 and the controller 14. The timing device 16 stores a predetermined time, such as 30 minutes, which can be set by user. The timing device 16 is configured to send the predetermined time to the controller 14. The controller 14 controls the lifting device 15 to lower the electronic sticks 12 from the first position to the second position during the course of the predetermined time.

It will be understood that the above particular embodiments are shown and described by way of illustration only. The principles and the features of the present disclosure may be employed in various and numerous embodiment thereof without departing from the scope of the disclosure as claimed. The above-described embodiments illustrate the possible scope of the disclosure but do not restrict the scope of the disclosure.

What is claimed is:

1. An electronic stick assembly, comprising:

a burning chamber;

a plurality of electronic sticks received in the burning chamber, each of the electronic sticks comprising a light guide bar, an glowing head, and a light source, the light guide bar comprising a first end and a second end away from the first end, the glowing head positioned at the first end, the light source positioned on the second end;

a wind speed sensor located on the exterior of the burning chamber, and configured to sense the changes in the wind speed outside the burning chamber; and a controller electrically connected to the wind speed sensor and the light source, the controller configured to adjust the brightness of the light source according to the wind speed sensed by the wind speed sensor, wherein when a wind speed sensed by the wind speed sensor increases, the controller increases the brightness of the light source; when the sensed wind speed slows, the controller decreases the brightness of the light source; otherwise the controller maintains the brightness of the light source at a certain stable level.

2. The electronic stick assembly of claim 1, further comprising a lifting device received in the burning chamber, wherein the electronic sticks are positioned on the lifting device, the lifting device is electrically connected to the controller, the controller controls the lifting device to move the electronic sticks from a first position to a second position along a length direction of the electronic sticks.

3. The electronic stick assembly of claim 2, further comprising a cover, wherein the burning chamber is a hollow chamber, the cover is configured to cover the burning chamber, the cover defines a plurality of through holes, the electronic sticks is positioned on the lifting device, with each of the light guide bars running through a respective one of the through holes.

4. The electronic stick assembly of claim 3, wherein the wind speed sensor is positioned on the cover.

5. The electronic stick assembly of claim 2, wherein the lifting device moves the electronic sticks from the first position to the second position at a uniform speed.

6. The electronic stick assembly of claim 2, wherein when the electronic sticks locate at the first position, the electronic sticks are totally exposed outside the burning chamber; when the electronic sticks locate at the second position, the electronic sticks are retracted in the burning chamber.

7. The electronic stick assembly of claim 6, wherein when the electronic sticks locate at the second position, the controller controls the lifting device to move the electronic sticks back to the first position.

8. The electronic stick assembly of claim 2, further comprising a time device, the time device electrically connected to the lifting device and the controller, the timing device storing a predetermined time, the timing device configured to send the predetermined time to the controller, the controller controlling the lifting device to lower the electronic sticks moving from the first position to the second position at the predetermined time.

9. The electronic stick assembly of claim 1, wherein the glowing head is bullet shaped.

10. The electronic stick assembly of claim 1, wherein the light source can be a lamp or a light emitting diode.

* * * * *